United States Patent [19]

Carroll

[11] Patent Number: 4,534,395

[45] Date of Patent: Aug. 13, 1985

[54] FOLDING DOOR

[75] Inventor: William F. Carroll, Pasadena, Calif.

[73] Assignee: Secton Pty. Ltd., Dandenong, Australia

[21] Appl. No.: 429,634

[22] Filed: Sep. 30, 1982

[30] Foreign Application Priority Data

Oct. 1, 1981 [AU] Australia ..... PF1024

[51] Int. Cl.[3] ..... E06B 3/48; E05D 15/26

[52] U.S. Cl. ..... 160/199; 160/118; 160/206

[58] Field of Search ..... 160/118, 206, 198, 199, 160/195, 206, 229 R, 97, 135; 49/141

[56] References Cited

U.S. PATENT DOCUMENTS

| | | | |
|---|---|---|---|
| 1,051,054 | 1/1913 | Anderson | 160/118 |
| 2,307,560 | 1/1943 | Apel | 160/199 X |
| 3,136,538 | 6/1964 | Dimmitt et al. | 49/141 X |
| 3,318,047 | 5/1967 | Carson | 49/141 |

FOREIGN PATENT DOCUMENTS

| | | | |
|---|---|---|---|
| 504254 | 7/1951 | Belgium | 160/229 R |

*Primary Examiner*—Peter M. Caun
*Assistant Examiner*—Cherney S. Lieberman

[57] ABSTRACT

A power actuated folding door having two panels hinged to each other, one panel being hinged to a door jamb. The panels are movable by a linearly movable element, acting on the outermost door panel from the door jamb, from a closed position at which the panels are generally coplanar to an open position at which they are folded back upon each other.

7 Claims, 6 Drawing Figures

FOLDING DOOR

BACKGROUND OF THE INVENTION

Field of the Invention

This invention relates to folding doors.

BRIEF SUMMARY OF THE INVENTION

According to the present invention there is provided a folding door having a first panel with first hinge means at a first edge adapted for pivotally connecting the panel to an upright surface adjacent a door opening, for pivoting of the panel about an upright axis adjacent the surface, and a second panel pivotably connected at a first edge thereof by second hinge means at an edge of the first panel opposite said first edge thereof, and movement means adapted to move the door panels from a closed position at which the two panels are substantially in a common plane and to an open position at which said first panel is pivoted away from the location adopted in the closed position and the second panel is folded back upon the first panel, the movement means comprising a movable member mounted for movement generally parallel to said common plane of the door panels in the closed position and having coupling means coupling the movable member to the second panel; said coupling means pivotally interconnecting the movable member to the second panel such that the second panel is pivotal relative to the movable member about a pivot axis which is substantially fixed relative to the movable member and which pivot axis is substantially parallel to said upright axis and moves during opening and closing of the door in a plane parallel in said common plane, the coupling between the movable member and second panel being releasable under pressure applied normal to the plane of the second panel to permit pivotal movement of the first and second panels to an open position without the said folding occuring.

BRIEF DESCRIPTION OF THE DRAWINGS

The invention is further described with reference to the accompanying drawings in which.

DETAILED DESCRIPTION

Figure 1:
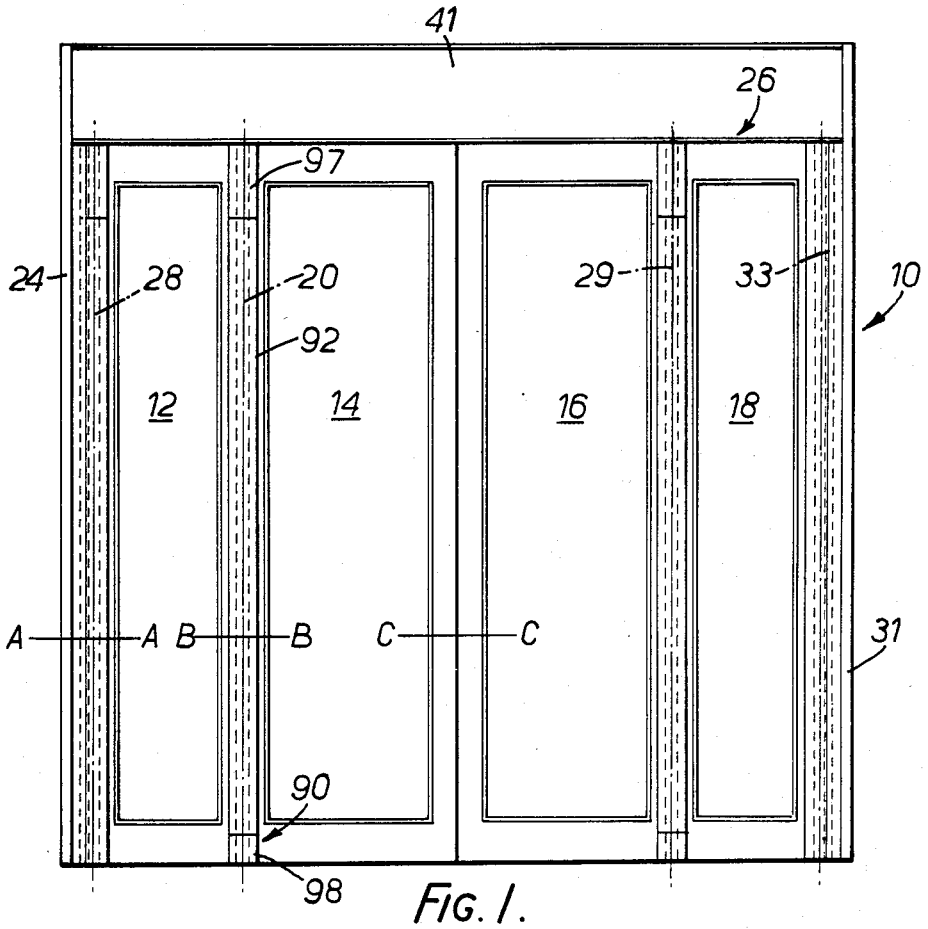
FIG. 1 is a front elevational view of a door constructed in accordance with the invention.

The door 10 shown in FIG. 1 comprises four panels 12, 14, 16, 18. Panels 12 and 14 are hinged together about adjacent upright edges for pivotal movement one relative to the other about the upright axis 20 shown in FIG. 1. Panel 12 is hinged to one jamb 24 of a doorway, generally indicated by reference numeral 26, for pivotal movement of panel 12 about an upright axis 28. Similarly, panels 16, 18 are hinged together about an upright axis 29 and panel 18 is hinged to a second door jamb 31 of doorway 26 about the upright axis 33 shown.

Figure 4:
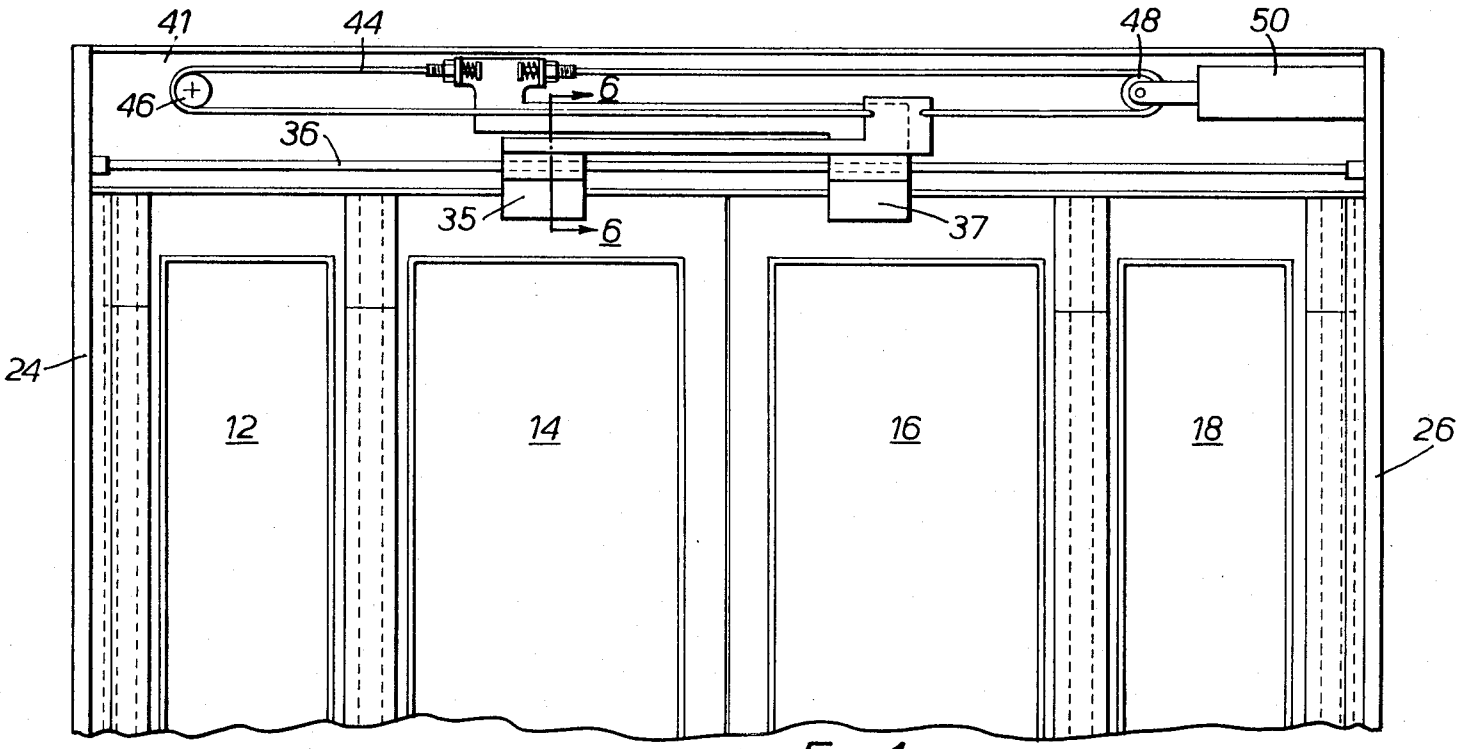
FIG. 4 is an enlarged fragmentary elevational view of the upper part of the door of FIG. 1 with a cover portion removed to show the internal driving mechanism.

As shown in FIG. 4, panels 14, 16 are pivotally connected to respective carriages 35, 37 mounted for sliding movement along a rod 36 positioned within a transom 41 of doorway 26 and above the panels 12, 14, 16, 18. Carriages 35, 37 are connected respectively to lower and upper runs of an endless chain 44. Chain 44 extends around end sprockets 46, 48 located at opposite sides of doorway 26, and sprocket 48 is coupled to a drive motor 50 for rotating the sprocket.

When motor 50 is operated, the sprocket 48 is driven to drive the upper and lower runs of chain 44 in opposite directions thereby moving the carriages 35, 37 towards each other or away from each other depending on the direction of rotation.

Figure 2:
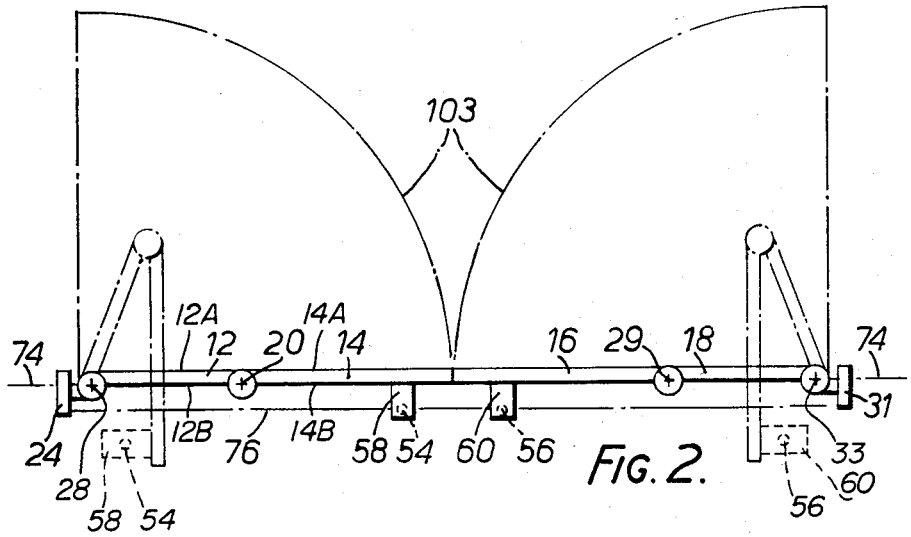
FIG. 2 is a diagrammatic plan view of the door of FIG. 1.

As shown in FIG. 2 the carriages 35, 37 are coupled to the panels 14 and 16 by pivot pins 54, 56 having upright axes. The pivot pins 54, 56 are carried by respective brackets 58, 60 affixed to and projecting out of the planes of the respective panels 14, 16. As will be apparent from FIG. 2, the axes of the pins 54, 56 are offset relative to a plane generally designated by reference numberal 74 which contains the pivotal axes 28, 20, 29, 33. The pins 54, 56 are coupled (in a manner described later) to the respective carriages 35, 37 in such a manner that the pins although normally contained for bodily movement with the respective carriages as these move along the rods 36, are capable of rotational movement about the axes thereof relative to the respective carriages.

In the closed condition of the door, the panels 12, 14, 16, 18 are co-planar and close doorway 26. On operation of motor 50, however, in a direction to cause the carriages 35, 37 to be moved away from each other along the axis of rod 36, the pins 54, 56 correspondingly move away from each other along the path indicated by phantom line 76 in FIG. 2. This movement causes the brackets 58, 60 to be correspondingly moved away from each other so that the panels 12, 14 are folded one relative to the other about the pivot axis 20 one back upon the other whilst at the same time the panel 12 is turned about axis 28 through almost 90°. Similarly, the panels 16, 18 are folded about the pivot axis 29 one back upon the other, whilst at the same time panel 18 is turned about axis 33 through almost 90°. The panels 12, 14, 16, 18 thus then adopt the folded, open, position shown by broken lines in FIG. 2. The offsetting of the axes of the pins 54, 56 from the common plane of the axes 28, 20, 29, 33 ensures that the pairs of panels 12, 14 and 16, 18 are respectively both moved to be positioned to the same side of the doorway 26 in the open condition. Where doorway 26 is at an external wall of a building those positions would normally be outside the doorway 26.

Figure 5:
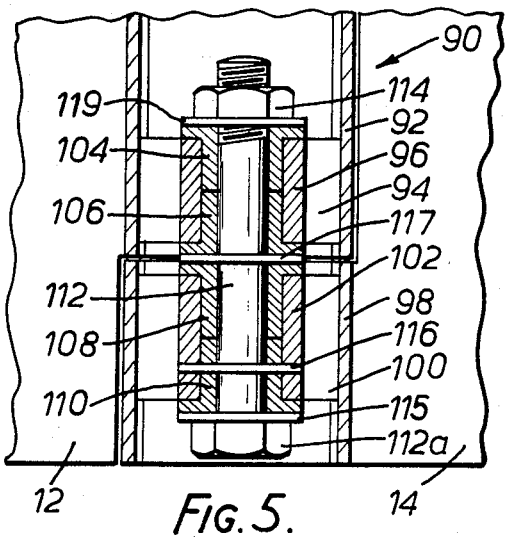
FIG. 5 is an enlarged vertical section of a hinge incorporated into the door of FIG. 1.

The hinging of the panels to the doorway and to each other may be accomplished by use of hinges of like form. One such hinge is shown in FIG. 5 indicated by reference numeral 90. There are eight hinges like hinge 90, one at each end of each of the axes 28, 20, 39 and 33. The hinge 90 shown in FIG. 5 is that between panels 12 and 14 at the lower ends thereof.

The hinge 90 includes a lower portion of an axially extending hollow tube 92 attached to panel 12 adjacent panel 14. A bearing support member 94 is positioned within the tube 92 at the base thereof and secured as by welding to the tube 92. Member 94 carries a central hollow cylindrical portion 96. A second tube 98 forming part of hinge 90 is of the same form as tube 92 and is coaxially arranged below tube 92, being secured to panel 14. A support member 100, like member 94, is positioned within and secured to tube 98. Member 100 has a central hollow cylindrical portion 102 similar to and coaxial with portion 96 of member 94. A thrust bearing formed by two coaxial bearing units 104, 106 is positioned within portion 96 of member 94 and a similar thrust bearing formed from two bearing units 108, 110 is positioned within portion 102 of member 100. A bolt 112 extends upwardly through the bearing constituted by bearing units 108, 110 and thence through that constituted by bearing units 104, 106. Washers 115, 117, 119 are respectively interposed between the head 112*a* of the bolt 112 and the bearing unit 110, between the bearing units 106 and 108, and above the bearing unit 104. A nut 114 is threadedly engaged on bolt 112 at the upper end, above washer 119. Bolt 112 constitutes a pivot pin for the hinge 90 and is arranged to permit the panel 14, together with the tube 98 and member 100 to rotate about the axis of the pin relative to the panel 12, tube 92 and member 94. The bolt 112 is constrained within the member 100 by means of a pin 116 extending transversely through portion 102 of member 100, through bearing unit 110 and through bolt 112.

Figure 3:
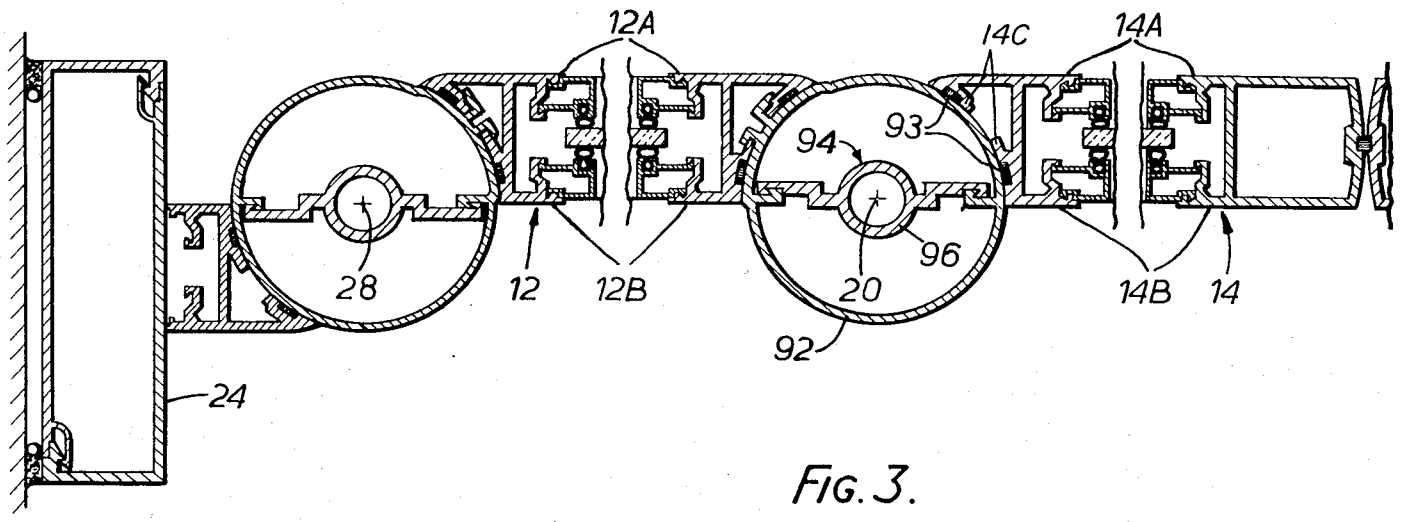
FIG. 3 is an enlarged fragmentary horizontal cross-section of the door of FIG. 1 taken approximately at the locations A—A and B—B and C—C in FIG. 1.

The tube 92 is arranged to be closely axially adjacent the tube 98 and to a corresponding tube 97 (FIG. 1), like tube 98 carried at the top of panel 14 and forming part of the upper hinge between panels 12 and 14. Thus, these three tubes form a neat continuous appearance when viewed from the exterior. The tubes 92, 97, 98 are also arranged to be of large diameter and, as best shown in FIG. 3, the tube 92 cooperates with an arcuately formed adjacent edge 14C on panel 14 so that under rotation of the panel 14 relative to panel 12 the gap between the panel edge and the tube 92 remains constant. As shown in FIG. 3 this gap is arranged to be quite small, of the order of 1/16 inch so as to ensure good safety and to minimize the possibility of injury to persons by interposition of fingers or the like onto the gap between the tube 92 and the panel edge. Entry of dirt into the space between the tube 92 and the edge of door panel 14 is minimized by the provision of two lengthwise extending "bristle" sealing elements 93 arranged to seal the gap and carried by tube 92. It will also be noted from FIG. 3 that the axis 20 of pivoting between the two panels 12, 14 is arranged to be offset from the general median plane of the panels, being more aligned with the inside surfaces 12B, 14B of the panels 12 and 14 when the panels are in the closed position. In this way, when the panels 12 and 14 are pivoted about axis 20, it is possible for the inner surfaces 12B and 14B of the panels to move toward each other and fold through a total angle of almost 180 degrees (See FIG. 2). However, if the panels are pivoted about axis 20 in the opposite direction, the outer surfaces 12A and 14A of the panels will engage each other and thus restrict the pivotal movement in that direction of the panels relative to each other.

The pivotal interconnections between door panels 16, 18 are substantially identical to those, just described, between panels 12, 14, panel 18 carrying a tube like tube 92 and panel 16 carrying tubes like tubes 97, 98 these tubes all coaxially arranged and having components forming upper and lower hinges like the hinge 90 described. The pivotal interconnections between door jamb 24 and panel 12, and between panel 18 and door jamb 26 are likewise similar to that described, each again employing tubes corresponding to tube 92, affixed to panels 12, 18 and coaxial tubes like tubes 97, 98 affixed to jambs 24, 31, together with components forming upper and lower hinges like like hinge 90.

Figure 6:
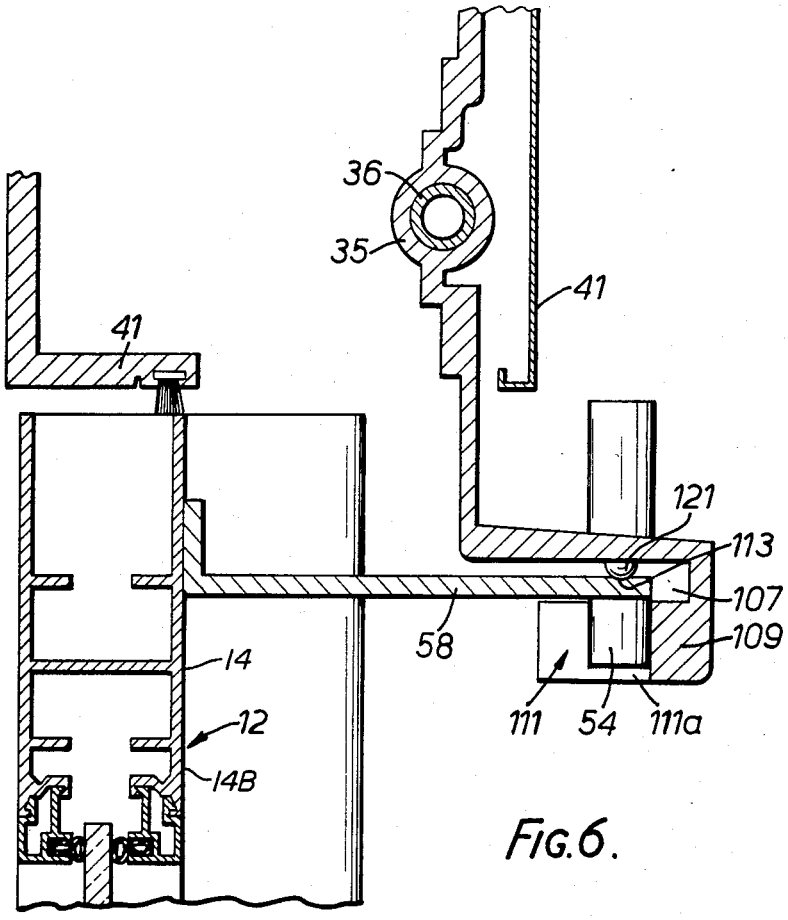
FIG. 6 is an enlarged section on the line 6—6 in FIG. 4.

The pins 54, 56 are coupled to the carriages 35 and 37 in a fashion permitting decoupling of the pins from the carriages under substantial pressure applied to the door panels 14, 16 from the inside of the door, that is to say, against the surfaces 12B, 14B of the door panels to which the pins 54 and 56 are adjacent. More particularly, in the case of the interconnection between panel 14 and carriage 35 as shown in FIG. 6, the pin 54 is arranged to depend from bracket 58 and the outer end of the bracket 58 and the pin 54 both extend into a cavity 107 which is formed in a bearing element 109 forming part of carriage 35. Element 109 has an inwardly open recess 111 which, at its blind end, has a semi-cylindrical surface 111*a* of complementary form to the cylindrical pin 54. By suitable swinging of panel 14, the outer end of the bracket 58 as well as pin 54 can be entered into the cavity 107 so that pin 54 passes through the open end of the recess 111 to be received therein with the pin 54 engaged against surface 111*a*. The bracket 58 has, on its upper surface, a semi-hemispherical recess 113 and, when the pin 54 is so extended into recess 111 as to engage surface 111*a*, the recess 113 is brought into vertical alignment with a ball 121 which is resiliently biased downwardly from a location at the roof of cavity 107 to enter into and be resiliently held in the recess 113. Then, ball 121 and recess 113 form a detent mechanism normally holding pin 54 in element 109 such that the pin 54 and bracket 58 can axially rotate relative to carriage 35 but not undergo translation relative thereto. Under the aforementioned pressure applied to panels 14, 16 from the inside, the resilient bias applied to the ball 121 is overcome, permitting the ball to move upwardly and dislodge from recess 113 to allow the pin 54 to withdraw from the recess 111 and the bracket 58 to withdraw from cavity 107. Then, the panels 12 and 14 may move in substantially coplanar relationship out of the plane of the door opening to permit them to be outwardly hinged about axis 28 as indicated by the phantom lines 103 in FIG. 2. The interconnection between carriage 37 and panel 16 is substantially the same as the interconnection, shown in FIG. 6, between panel 12 and carriage 35. Thus, under the described emergency condition of applied pressure against panel 16, the panels 16 and 18 may undergo coplanar movement by pivoting about axis 33. This provides that in an emergency where, for example, no power were available to operate motor 50, it would still be possible to gain access through the door by pressure applied against any of panels 12, 14, 16 or 18. In the construction shown, the permitted movement of the panels 12, 14 relative to each other about axis 20 would still permit some degree of pivoting of the panel 14 relative to panel 12, during such emergency opening, but it would be possible, of course, to arrange suitable stop means to prevent any such pivoting of the panels 12, 14 relative to each other during emergency opening.

I claim:

1. A folding door having a first panel with first hinge means at a first edge adapted for pivotally connecting the panel to an upright surface adjacent a door opening, for pivoting of the panel about an upright axis adjacent the surface, and a second panel pivotably connected at a second edge thereof by second hinge means at an edge of the first panel opposite the first edge thereof, and movement means adapted to move the first and second panels from a closed position at which the two panels are substantially in a common plane to an open position at which the first panel is pivoted away from a location adopted in the closed position and the second panel is folded back upon the first panel, the movement means comprising a movable member mounted for movement generally parallel to the common plane of the panels and having coupling means coupling the movable member to the second panel; the coupling means pivotally interconnecting the movable member to the second panel such that the second panel is pivotal relative to the movable member about a pivot axis which is substantially fixed relative to the movable member and which pivot axis is substantially parallel to the upright axis and moves during opening and closing of the door in a plane parallel to the common plane, the coupling between the movable member and the second panel being releasable under pressure applied normal to the plane of the second panel to permit pivotal movement of the first and second panels to an open position without folding of the panels occuring.

2. A folding door as claimed in claim 1 wherein the coupling means comprises:

a coupling member, carried by the second panel and engaging the movable member so as to be carried therewith during movement of the movable member generally parallel to the common plane, the coupling member being pivotal relative to the movable member about the pivot axis, and retaining means for constraining the coupling member against movement relative to the movable member otherwise than by pivotal rotation about the pivot axis, the retaining means being sensitive to the pressure applied normal to the plane of the second panel to release the coupling member from the movable member.

3. A folding door as claimed in claim 2 wherein the coupling member includes a pin rotatably received in an open-sided cavity in the movable member and the retaining means comprises an element resiliently biased away from the movable member against the coupling member at a location on the axis of the pin to permit release to a occur by movement of the pin through an open side of the cavity when the pressure applied normal to the plane of the second panel is sufficient to overcome a retaining force provided by the resilient means.

4. A folding door as claimed in claim 1 wherein the second hinge means between the first and second panels is arranged to permit the two panels to be pivoted during normal opening movement to effect the folding but to at least substantially limit pivoting of the second panel relative to the first panel out of a co-planar relationship where both panels are moved together to the open position without folding.

5. A folding door as claimed in claim 1 wherein the plane parallel to the common plane, in which the pivot axis moves during opening and closing of said door, is offset from the common plane.

6. A folding door as claimed in claim 1 wherein the second hinge means comprises first, second, and third tubes aligned in end to end adjacent dispositions, the first and third tubes being secured to one panel so as to extend along one edge thereof and the second tube being secured to the other panel so as to extend along one edge thereof, hinge elements being provided pivotally interconnecting the first and second tubes and the second and third tubes to permit a rotation of the first and third tubes about the common axis of the tubes relative to the second tube, the second tube extending substantially along the full length of one edge of the other panel and the one panel having an edge thereof lengthwise adjacent said second tube and formed of concave arcuate cross section to be closely spaced to the exterior of the second tube during pivotal movement of the one panel relative to the other panel about the axis.

7. A folding door as claimed in claim 6 wherein the tubes are of greater diameter than the thickness of the panels.

* * * * *